US005348275A

United States Patent [19]

Soofi

[11] Patent Number: 5,348,275

[45] Date of Patent: Sep. 20, 1994

[54] TUNDISH NOZZLE ASSEMBLY BLOCK

[75] Inventor: Madjid Soofi, St. Charles, Ill.

[73] Assignee: Magneco/Metrel, Inc., Addison, Ill.

[21] Appl. No.: 97,155

[22] Filed: Jul. 26, 1993

[51] Int. Cl.[5] ..... B22D 41/50

[52] U.S. Cl. ..... 266/236; 266/275; 222/591

[58] Field of Search ..... 222/591, 600, 606, 607; 266/236, 280, 286, 275

[56] References Cited

U.S. PATENT DOCUMENTS 3,333,746 8/1967 Cope et al. ..... 222/591
3,511,261 5/1970 Bick et al. ..... 222/591
4,079,869 3/1978 Meier et al. ..... 222/600
4,096,976 6/1978 Daussan ..... 222/591
4,268,015 5/1981 Luhrse et al. ..... 266/236
4,776,502 10/1988 Hagenburger et al. ..... 222/591
5,044,533 9/1991 King ..... 222/606

*Primary Examiner*—Scott Kastler
*Attorney, Agent, or Firm*—Willian Brinks Hofer Gilson & Lione

[57] ABSTRACT

A two-piece tundish nozzle assembly block is provided for the drain regions of tundish vessels. The two-piece assembly block includes a lower main block firmly mounted in the refractory lining of the tundish, and a selectively removable top sleeve which, together with the refractory lining, protects the lower main block from direct exposure to molten iron or steel. The top sleeve is directly exposed to molten iron or steel passing into the drain. The top sleeve is not strongly bonded in place, and can be easily removed and replaced when worn or damaged.

20 Claims, 3 Drawing Sheets

TUNDISH NOZZLE ASSEMBLY BLOCK

FIELD OF THE INVENTION

This invention is directed to a two-piece nozzle assembly block which is inserted in the refractory lining of a metallurgical vessel, for example, a tundish vessel, in the region of the exit nozzle. This invention also includes a tundish vessel which is equipped with the two-piece tundish nozzle assembly block.

BACKGROUND OF THE INVENTION

Tundish vessels in the iron and steel industry are used to process (i.e. purify) molten iron or steel at temperatures up to about 3300° F. The molten metal enters the vessel at a location known as the "pouring region" or "impact region." From there, the molten metal is caused to flow toward one or more drains in the floor of the tundish vessel at locations remote from the pouring region. The flow is regulated so that the molten metal has an average "residence time" in the vessel sufficient to allow impurities in the molten metal to rise to the top of the vessel before the molten metal exits through the drains. This can be accomplished using baffles, dams, weirs, and other flow control devices strategically positioned between the pouring region and the drains.

In order to withstand the continuous exposure to hot molten metal, steel tundish vessels are lined on the inside with a high temperature-resistant refractory insulating material that is also resistant to oxidation, corrosion and erosion. The refractory lining can be made from one or more castable refractory materials known in the art including, for example, refractory fibers (e.g. aluminum silicate, calcium silicate), refractory fillers (e.g. alumina, silica, silicates, magnesia), and binder (e.g. colloidal silica, sodium silicate, starch, phenol-formaldehyde resin, urea formaldehyde resin). Eventually, these refractory lining materials wear out, causing the need for repair or replacement.

In some areas of the tundish, including the drain, the refractory materials are exposed to comparatively greater stresses than in the main body of the tundish. At the drains, the velocity of the molten metal is faster than in the main body because a relatively large volume of steel is being channeled through comparatively small openings which cover only a minor portion of the surface area on the tundish floor. As a consequence, the refractory material which protects the drain regions wears out more quickly than the refractory material covering most of the tundish vessel.

In the past, a special procedure has been employed for placing and replacing refractory material in the drain regions of tundish vessels. At the outset, a large circular depression or opening (for example, a depression having a diameter three times the diameter of the drain) is present in the refractory lining surrounding the drain. A refractory drain nozzle was positioned in the drain opening in the steel shell, extending upward into the center of the larger circular depression in the refractory lining. Then, the space between the refractory drain nozzle and the refractory lining (constituting about two-thirds of the diameter of the depression in the refractory lining) was filled with a refractory ramming material using a conventional ramming process.

The ramming process was very labor-intensive and time consuming, requiring as much as 400 lbs. of ramming material. Every time the "rammed" area around the drain became worn or damaged, the entire block of ramming material had to be removed, and the ramming process repeated. This procedure was expensive and required significant "down time" during which the tundish vessel could not be used.

SUMMARY OF THE INVENTION

The present invention is directed to a two-piece tundish block assembly which overcomes the need for the labor-intensive ramming process previously used in the drain regions of tundish vessels. A tundish vessel of the type previously known, having an inner refractory lining, an outer steel shell, one or more (usually four) walls, a floor, a pouring region, and at least one drain opening in the floor, is provided. The tundish vessel has a depression formed in the refractory lining in the area surrounding the drain opening. This depression has a diameter larger than (for example, three times larger than) the diameter of the drain opening passing through the outer steel shell.

Instead of using the conventional ramming process for filling the depression with refractory material, the following expedited procedure is employed. First, a lower main block of refractory material is placed inside the depression. The lower main block includes an inner wall defining a hollow portion, an outer wall, and top and bottom surfaces extending between the inner and outer walls. The lower main block is firmly and permanently mounted in the depression.

Next, a standard refractory nozzle is inserted centrally in the hollow portion of the lower main block, extending downward through the drain opening in the steel shell. The lower portion of the refractory nozzle intersects the steel shell and is mounted thereto.

Next, a top sleeve is placed above and inside the hollow portion of the lower main block. The top sleeve includes a surface (for example, a horizontal extension) which covers the top surface of the lower main block, another surface (for example, a vertical extension) which covers the inner wall of the lower main block, and an inner hollow portion defined by the top sleeve (for example, by the vertical extension of the top sleeve). The top sleeve is removably (i.e. superficially) bonded to the lower main block, and is more firmly bonded to the nozzle.

During use of the tundish, the top sleeve and the refractory nozzle experience considerable wear from the flow of molten iron or steel through the drain. However, the top sleeve works together with the main refractory lining of the tundish to protect the lower main block from significant exposure or wear. Therefore, the lower main block, which fills a large part of the depression in the refractory lining, does not require repair or replacement any more often than the main refractory lining.

Only the top sleeve and the nozzle require frequent replacement due to their continuous direct exposure to molten metal flowing through the drain. However, this replacement can be quickly and easily accomplished by removing the top sleeve (preferably, with the nozzle firmly attached) and inserting a new top sleeve and nozzle. The labor-intensive ramming process is thereby avoided, and considerable amounts of refractory material and time are saved.

With the foregoing in mind, it is a feature and advantage of the invention to provide a two-piece nozzle assembly block which significantly reduces the time, effort and expense required to repair tundish vessels in the regions of the drains.

It is also a feature and advantage of the invention to provide a two-piece nozzle assembly block which is conveniently adapted for use with a standard tundish vessel having a standard refractory lining, and with a standard tundish nozzle.

It is also a feature and advantage of the invention to provide a tundish vessel which incorporates the two-piece nozzle assembly block of the invention, in the region of the tundish drain.

The foregoing and other features and advantages of the invention will become further apparent from the following detailed description of the presently preferred embodiments, read in conjunction with the accompanying drawings. The detailed description and drawings are intended to be illustrative rather than limiting, the scope of the invention being defined by the appended claims and equivalents thereof.

DETAILED DESCRIPTION OF THE PRESENTLY PREFERRED EMBODIMENTS

Figure 1:
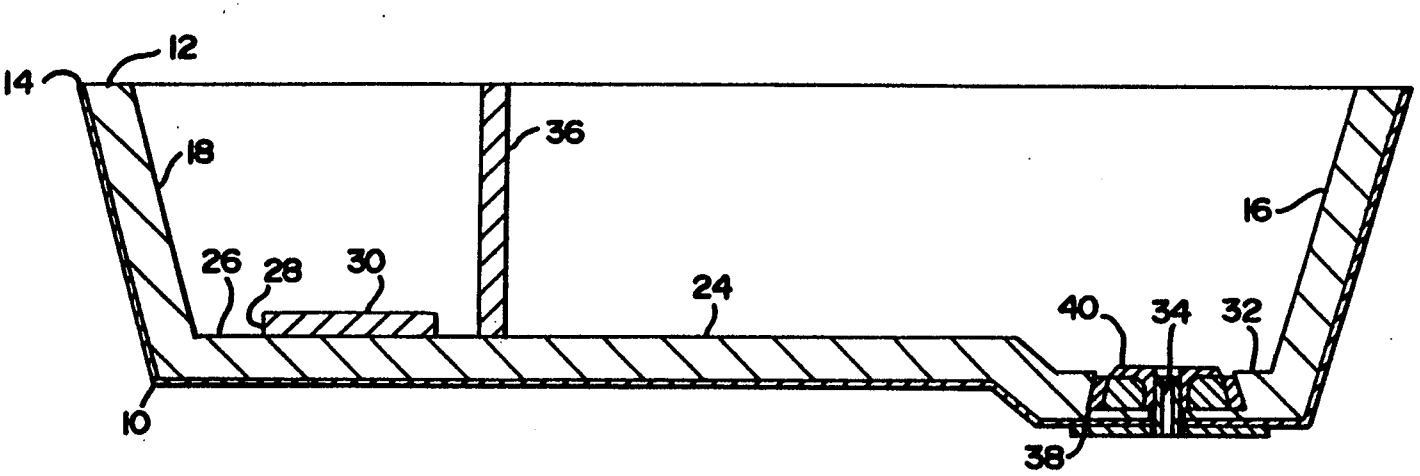
FIG. 1 is a side sectional view of a tundish vessel, having a two-piece nozzle assembly block of the invention in the drain region.
Figure 2:
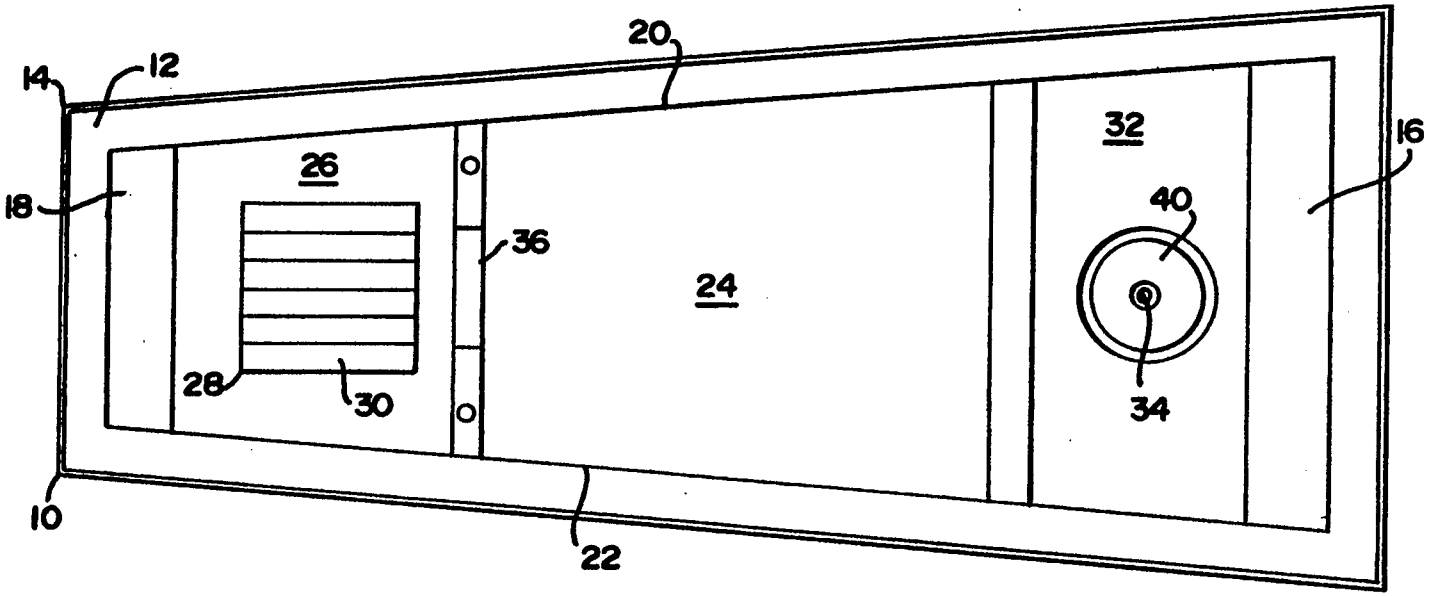
FIG. 2 is a top plan view of the tundish vessel shown in FIG. 1.

Referring to FIGS. 1 and 2, a tundish vessel, generally designated as 10, has an inner refractory lining 12 and an outer steel shell 14. The tundish vessel 10 has, on the inside, a front wall 16, a back wall 18, two side walls 20 and 22, and a floor 24. The floor 24 includes an impact region 26 for receiving molten iron or steel from a ladle. An impact pad 28 having a wavy upper surface 30 is located on the floor 24 in the region of impact 26, for reducing the vertical splashing and turbulence caused by molten metal being poured into the tundish vessel 10.

The floor 24 also includes a drain region 32, through which molten metal exits via a refractory nozzle 34. The refractory nozzle 34 is surrounded by a two-piece nozzle assembly block of the invention, generally designated as 40, which is described in detail below. The two-piece nozzle assembly block 40 is mounted in a circular depression 38 formed in the inner refractory liner 12, in the drain region 32. An upright baffle 36 having a plurality of flow openings (not shown) is mounted transversely across the tundish between the side walls 20 and 22, for regulating the flow of molten metal from the impact region 26 toward the drain region 32.

Figure 3:
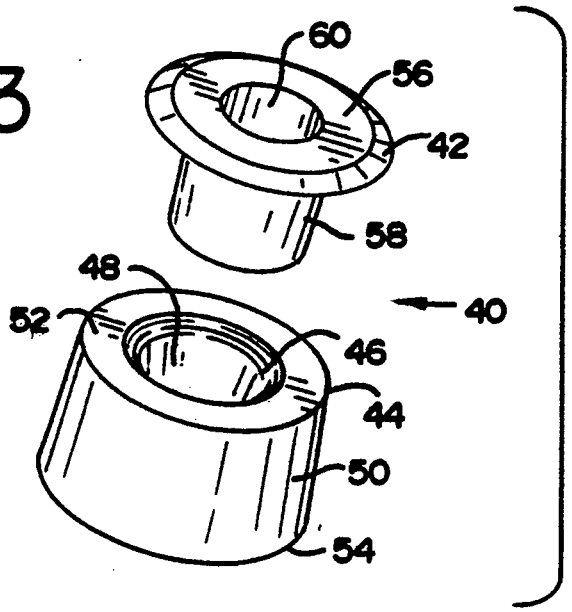
FIG. 3 is a perspective view of the two-piece nozzle assembly block of the invention, showing the top sleeve separated from the lower main block.

Referring to FIG. 3, the two-piece nozzle assembly block 40 includes a selectively removable top sleeve 42 and a lower main block 44. The lower main block 44 includes an inner wall 46 defining a hollow portion 48, an outer wall 50, and top and bottom walls 52 and 54 extending between the inner and outer walls 48 and 50. The inner wall 46 preferably has a circular cross-section, while the outer wall 50 preferably surrounds the inner wall 46 and has a circular cross-section concentric with the cross-section of the inner wall 46. The hollow portion 48, being defined by the inner wall 46, has the same circular cross-section as the inner wall 46.

The selectively removable top sleeve 42 includes a horizontal extension 56 of sufficient size to completely cover the top wall 52 of the lower main block 44, and a vertical extension 58 intersecting the horizontal extension 56 having sufficient size to completely cover the inner wall 46 of the lower main block 44, when the two-piece nozzle assembly block 40 is joined together. The vertical extension 58 of the top sleeve 42 defines an inner hollow portion 60 of circular cross-section which coincides with, and is concentric with, the hollow portion 48 of the lower main block 44 when the two-piece nozzle assembly block 40 is joined together.

The lower main block 44 and the top sleeve 42 are preferably constructed of one or more high temperature-resistant refractory materials capable of withstanding exposure to molten metal at temperatures up to about 3300° F. The top sleeve 42, which makes direct contact with molten metal, can be constructed of $Al_2O_3$ and its compounds, MgO and its compounds, zirconia and its compounds, $Al_2O_3$.SiC and its compounds, or a combination of these materials. The preferred refractory material for the top sleeve 42 is high alumina. The lower main block 44, which, during operation, is protected by the top sleeve 42 from making direct contact with molten metal, can also be constructed from $Al_2O_3$ and its compounds, MgO and its compounds, zirconia and its compounds, $Al_2O_3$.SiC and its compounds, or a combination of these materials. The preferred refractory material for the lower main block 44 is high alumina.

Figure 4:
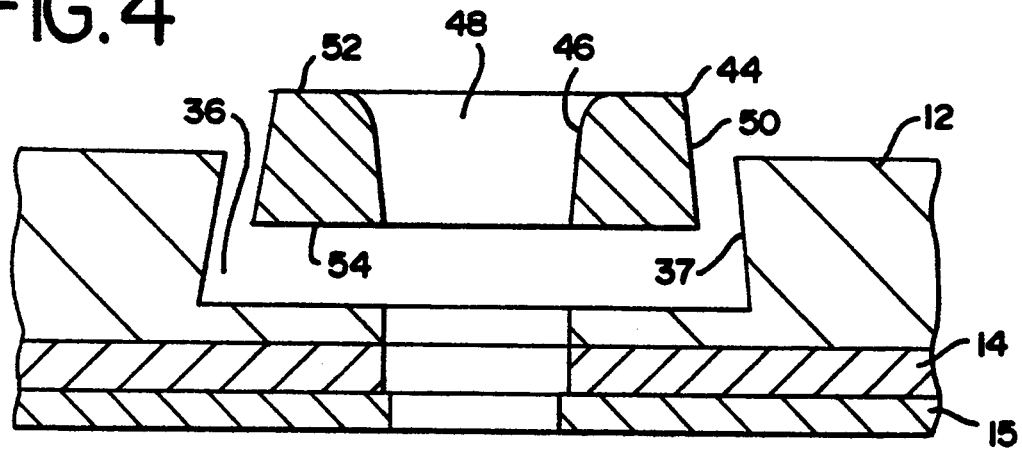
FIG. 4 is a side sectional view of the lower main block and the drain region of the tundish vessel, during insertion of the lower main block.

Referring now to FIGS. 4–8, the two-piece nozzle assembly block 40 is mounted, first, by applying a layer of heat-resistant mortar to the bottom surface 54 of the lower main block 44. The heat-resistant mortar is preferably a "super-duty" mortar of high alumina content, for example, a bonding mortar including 90% by weight or more of alumina and a balance of other refractory materials such as silica, calcia, titania and magnesia. The lower main block 44 is then centered and lowered into the depression 36 formed in the refractory liner 12 as shown in FIG. 4. The super-duty mortar helps bond the lower main block 44 firmly and permanently in place in the depression 36.

Figure 5:
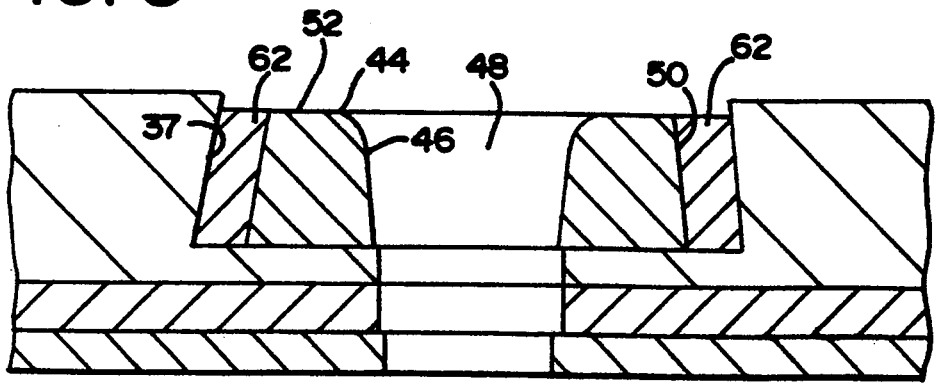
FIG. 5 shows the lower main block and tundish drain region of FIG. 4, after insertion of the lower main block.

Referring to FIG. 5, a uniform gap exists between the outer wall 50 of the lower main block 44, and the side wall 37 of the depression 36, after the lower main block 44 has been centered and lowered into place. In order to further secure the lower main block 44 into place, this gap is filled with a refractory gunning material 62 as shown. A particularly suitable alumina-based refractory gunning material is Metgun-70, available from Magneco/Metrel, Inc. of Addison, Ill. However, any suitable high temperature-resistant refractory gunning material can be used to form the layer 62.

Figure 6:
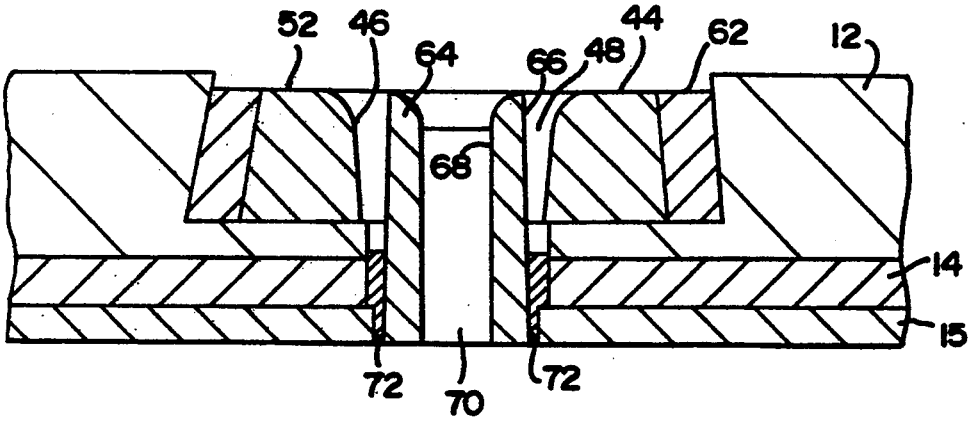
FIG. 6 shows the lower main block and tundish drain region of FIG. 5, after further insertion of a nozzle.

Referring to FIG. 6, a standard refractory nozzle 64 is next inserted in an upright position in the center of the hollow portion 48 defined by the inner wall 46 of the lower main block 44. The refractory nozzle 64 has an outer diameter which is less than the diameter of the hollow portion 48, and which is about one-third the diameter of the depression 36. The refractory nozzle 64 has an outer wall 66 and an inner wall 68 defining a passage 70. The refractory nozzle 64 extends through the hollow portion 48 in the lower main block 44, through the opening in the steel shell 14, and terminates in the vicinity of a slide gate valve assembly 15.

The slide gate valve assembly 15, the tundish nozzle 64, the outer steel shell 14, and the refractory liner 12 with the depression 36, are all standard items familiar to a person skilled in the art. The refractory nozzle 64 is bonded to the steel shell 14 and slide gate valve assembly 15 using a standard bonding material 72 known in the art as alumina grout. Other suitable bonding materials can also be used, provided that the bond achieved is strong enough to maintain the position of the nozzle 64 but not so strong as to prevent removal and replacement of the nozzle 64 at periodic intervals.

Figure 7:
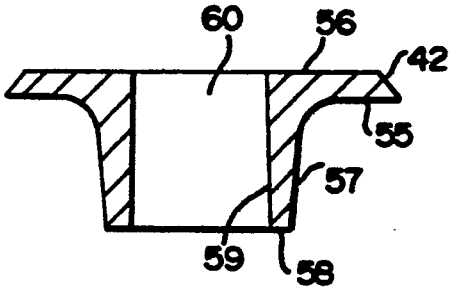
FIG. 7 is a side sectional view of the top sleeve of the two-piece nozzle assembly block.

Referring to FIG. 7, the next step is to prepare the top sleeve 42 for installation. This step involves the application of two different kinds of mortar to the top sleeve 42. The inner wall 59 of the top sleeve 42 is covered with a strong bonding mortar, such as the high alumina content "super duty" mortar described above. The purpose of the strong bonding mortar is to firmly secure the inner wall 59 of the top sleeve 42 to the outer wall 66 of the refractory nozzle 64 (FIG. 6).

The outer wall 57 of the vertical extension 58 (FIG. 7) and the lower wall 55 of the horizontal extension 56 are covered with a superficial-bonding or "anti-seize" material which facilitates easy separation of the outer wall 57 and the lower wall 55 of the top sleeve 42, from the inner wall 46 and top wall 52 of the lower main block 44 (FIG. 6). A particularly suitable superficial bonding material is a graphitic, low alumina mortar containing about 10% by weight graphite, about 60–70% by weight alumina, and a balance of other refractory materials such as silica, calcia, magnesia and titania.

Figure 8:
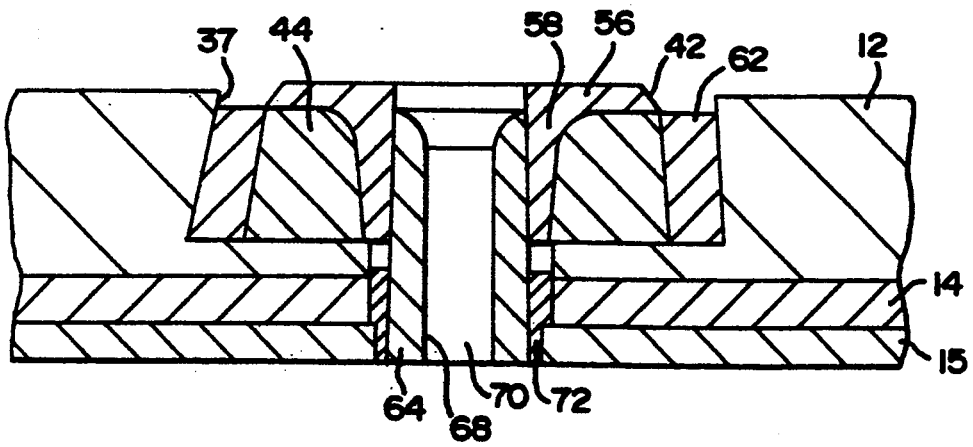
FIG. 8 shows the lower main block, nozzle and tundish drain region of FIG. 6, after insertion of the top sleeve of FIG. 7.

Finally, the top sleeve 42 is inserted as shown in FIG. 8, with the vertical extension 58 of the top sleeve 42 substantially filling the gap between the lower main block 44 and the refractory nozzle 64. In order to achieve optimum protection of the lower main block 44 from direct exposure to molten steel, it is important that the horizontal extension 56 of the top sleeve 42 (positioned adjacent the top wall 52 of the lower main block 44) be of sufficient size to completely cover the top wall 52 of the lower main block 44. It is also important that the vertical extension 58 of the top sleeve 42 (positioned adjacent the inner wall 46 of the lower main block 44) be of sufficient size to completely cover the inner wall 46 of the lower main block 44.

When the top sleeve 42 is inserted as shown in FIG. 8, the top portion of the refractory nozzle 64 is received in the hollow portion of the top sleeve 42, and becomes firmly bonded to the top sleeve 42 due to the layer of high alumina mortar on the inside surface 59 of the top sleeve 42. During operation of the metallurgical vessel, the top sleeve 42 and nozzle 64 experience the greatest wear from direct exposure to molten metal. When these parts become excessively worn or damaged, they can be removed at the same time and replaced, without removing the lower main block 44. This reduces significantly the time, effort and expense required compared to the prior art procedure, wherein the entire part of the depression 36 existing between the nozzle 64 and the depression wall 37 had to be filled with a ramming material every time significant wear occurred in the region of the nozzle 64.

While the foregoing embodiments of the invention are presently considered to be preferred, various changes and modifications can be made without departing from the spirit and scope of the invention. The scope of the invention is defined by the appended claims, and all changes and modifications within the meaning and range of equivalency of the claims are intended to be embraced therein.

I claim:

1. A tundish vessel comprising:

a floor, a back wall, a front wall, a pouring region, and at least one drain region;

a nozzle assembly block in the drain region, the nozzle assembly block including:

a lower main block including an inner wall defining a hollow portion, an outer wall, and top and bottom walls extending between the inner and outer walls; and a selectively removable top sleeve including a horizontal extension adjacent to the tundish floor which covers the top wall of the lower main block, a vertical extension intersecting the horizontal extension which covers the inner wall of the lower main block, and an inner hollow portion defined by the vertical extension for receiving a drain nozzle;

the horizontal extension including an upper surface which is at least as high as the tundish floor adjacent to the tundish floor; and a drain nozzle at least partially inside the inner hollow portion of the top sleeve and separate from the lower main block.

2. The tundish vessel of claim 1, wherein the inner and outer walls have circular cross-sections.

3. The tundish vessel of claim 1, wherein the lower main block comprises a high temperature-resistant refractory material.

4. The tundish vessel of claim 3, wherein the refractory material is selected from the group consisting of $Al_2O_3$, MgO, zirconia, $Al_2O_3$.SiC, and compounds and combinations thereof.

5. The tundish vessel of claim 1, wherein the selectively removable top sleeve comprises a high temperature-resistant refractory material.

6. The tundish vessel of claim 5, wherein the refractory material is selected from the group consisting of $Al_2O_3$, MgO, zirconia, $Al_2O_3$-SiC, and compounds and combinations thereof.

7. The tundish vessel of claim 1, wherein the selectively removable top sleeve is joined to the lower main block using a low-adhesive graphitic mortar.

8. The tundish vessel of claim 7, wherein the mortar comprises about 60–70 weight percent alumina, about 5–15 weight percent graphite, and a balance substantially of silica, calcia and magnesia.

9. A tundish vessel, comprising:

a floor, one or more walls, a pouring region, and at least one drain region;

a nozzle assembly block the drain region, the nozzle assembly block including:

a lower main block including an inner wall having a circular cross-section and defining a hollow portion, an outer wall having a circular cross-section surrounding the inner wall, and top and bottom surfaces Joining the inner and outer walls; and a selectively removable top sleeve which covers the inner wall and the top surface joining the inner and outer walls, the top sleeve defining an inner hollow portion;

the top sleeve including an upper surface which is at least as high as the tundish floor; and a drain nozzle at least partially inside the inner hollow portion of the top sleeve and separate from the lower main block.

10. The tundish vessel of claim 9, wherein the circular cross-sections of the inner and outer walls are concentric.

11. The tundish vessel of claim 9, wherein the inner hollow portion also has a circular cross-section.

12. The tundish vessel of claim 9, wherein the top sleeve comprises a vertical extension adjacent to the inner wall of the lower main block, and a horizontal extension adjacent to the top surface of the lower main block.

13. The tundish vessel of claim 9, wherein the lower main block and top sleeve each comprises a high temperature-resistant refractory material.

14. In a tundish vessel having an inner refractory lining, an outer steel shell, one or more walls, a floor, a pouring region and at least one drain opening, the improvement comprising:

a depression formed in the refractory lining surrounding the drain opening, the depression having a diameter larger than the drain opening;

a lower main block mounted in the depression, the lower main block including an inner wall defining a hollow portion, an outer wall, and top and bottom surfaces connecting the inner and outer walls;

a selectively removable top sleeve which covers the inner wall and the top surface joining the inner and outer walls, the top sleeve defining an inner hollow portion for receiving a drain nozzle; and a tundish drain nozzle commencing in the inner hollow portion and extending through the steel shell;

the top sleeve extending between the lower main block and the refractory nozzle.

15. The tundish vessel of claim 14, wherein the lower main block is permanently mounted in the depression.

16. The tundish vessel of claim 14, wherein the lower main block comprises a high temperature-resistant refractory material.

17. The tundish vessel of claim 14, wherein the top sleeve comprises a high temperature-resistant refractory material.

18. The tundish vessel of claim 14, wherein the hollow portion, the inner hollow portion, and the tundish nozzle have circular cross-sections.

19. The tundish vessel of claim 15, wherein the lower main block is gunned into place in the depression.

20. The tundish vessel of claim 14, wherein the depression has a diameter about three times as large as the drain opening.

* * * * *

UNITED STATES PATENT AND TRADEMARK OFFICE

CERTIFICATE OF CORRECTION

PATENT NO. : 5,348,275

DATED : September 20, 1994

INVENTOR(S) : Madjid Soofi

It is certified that error appears in the above-indentified patent and that said Letters Patent is hereby corrected as shown below:

Column 6, line 15, In claim 1, line 1, after "vessel" insert --,--.

Column 6, line 45. In claim 4, line 3, delete "$Al_2O_3$.SiC" and substitute --$Al_2O_3 \cdot SiC$--.

Column 6, line 52 In claim 6, line 3, delete "$Al_2O_3$-SiC" and substitute --$Al_2O_3 \cdot SiC$--.

Column 6, line 64. In claim 9, line 4, after "block" insert --in--.

Column 7, line 2, In claim 9, line 10, delete "Joining" and substitute --joining--.

Signed and Sealed this

Twenty-fourth Day of October, 1995

*Attest:*

*Attesting Officer*

Bruce Lehman

BRUCE LEHMAN

*Commissioner of Patents and Trademarks*